United States Patent [19]

Nakaniwa

[11] Patent Number: 5,007,399

[45] Date of Patent: Apr. 16, 1991

[54] METHOD AND APPARATUS FOR SELF-DIAGNOSIS OF AIR LEAKAGE IN CONTROL SYSTEM OF INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 528,615

[22] Filed: May 25, 1990

[30] Foreign Application Priority Data

May 25, 1989 [JP] Japan ..... 1-130025

[51] Int. Cl.[5] ..... F02M 51/00

[52] U.S. Cl. ..... 123/489; 123/494

[58] Field of Search ..... 123/489, 494, 492, 440, 123/488, 479; 364/431 T, 510

[56] References Cited

U.S. PATENT DOCUMENTS

| | | | |
|---|---|---|---|
| 4,796,591 | 1/1989 | Kiyono et al. | 123/492 |
| 4,807,151 | 2/1989 | Citron | 304/510 |
| 4,846,132 | 7/1989 | Binneevcis | 123/488 |
| 4,886,030 | 12/1989 | Oba et al. | 123/488 |
| 4,933,863 | 6/1990 | Okano et al. | 364/431.07 |
| 4,942,860 | 7/1990 | Chujo et al. | 123/494 |
| 4,945,883 | 8/1990 | Ono et al. | 123/494 |
| 4,951,209 | 8/1990 | Nagairhi et al. | 364/431.04 |

FOREIGN PATENT DOCUMENTS

| | | | |
|---|---|---|---|
| 60-153446 | 8/1985 | Japan | 123/489 |

*Primary Examiner*—Raymond A. Nelli

*Attorney, Agent, or Firm*—Foley & Lardner

[57] ABSTRACT

When there is observed a tendency that the proportion of the correction by an air-fuel ratio correction value for the feedback control of an air-fuel ratio in an air-fuel mixture sucked into an engine to a target air-fuel ratio is increased in the air-fuel ratio-enriching direction in a region of a smaller sucked air flow quantity, it is judged that the leakage of air into a suction system of the engine occurs. The quantity of the correction of the sucked air flow quantity corresponding to the quantity of leaking air is set based on the relation between the air-fuel ratio correction value and the corresponding sucked air flow quantity, and the detection value of an air flow meter is corrected based on this correction quantity.

6 Claims, 7 Drawing Sheets

METHOD AND APPARATUS FOR SELF-DIAGNOSIS OF AIR LEAKAGE IN CONTROL SYSTEM OF INTERNAL COMBUSTION ENGINE

BACKGROUND OF THE INVENTION (1) Field of the Invention

The present invention relates to a method and apparatus for the self-diagnosis of the air leakage in a control system of an internal combustion engine. More particularly, the present invention relates to a method and apparatus in which the leakage of air into a suction system of the engine is self-diagnosed and the detection value of the flow quantity of sucked air is corrected based on the result of the self-diagnosis.

(2) Description of the Related Art

There has been known a control system for electronically controlling the quantity of a fuel supplied into an engine, in which an sucked air flow quantity, which is a quantity of the state of sucked air participating in the quantity of air sucked into the engine, is detected by an air flow meter and the fuel supply quantity is variably set based on this detected sucked air flow quantity and the revolution speed of the engine (Japanese Unexamined Patent Publication No. 60-153446).

In an internal combustion engine, air purified by an air cleaner is supplied into the engine through a suction duct and a suction manifold and the sucked air flow quantity is controlled by a suction throttle valve. However, in the system for electronically controlling the fuel supply quantity based on the sucked air flow quantity in the above-mentioned manner, if air leaks into the suction system from a portion other than the prescribed air introduction system, it is apprehended that the following problems will arise.

More specifically, in a fuel supply control apparatus generally called "L-Jetro System" where the flow quantity of air is measured and the fuel supply quantity is electronically controlled based on the measured sucked air flow quantity, the structure is arranged so that all of sucked air is introduced into the engine through the air flow meter. However, if there is present leaking air sucked into the engine without being measured by the air flow meter (for example, air leaking from a clearance of a connecting part between parts constituting the suction system disposed downstream of the air flow meter), the fuel supply quantity is set at a quantity smaller than the quantity corresponding to the actually sucked air quantity, and the air-fuel ratio becomes leaner than the target air-fuel ratio. Accordingly, if the leakage of air takes place, misfire is caused and the unburnt gas is burnt in a catalyzer, resulting in occurrence of burnout of the catalyzer.

Furthermore, in the case where an ignition system for performing electronic control according to the ignition timing set based on the basic fuel supply quantity set by the sucked air flow quantity is disposed, if the basic fuel supply quantity comes to include an error because of occurrence of the leakage of air, the set ignition timing deviates from the value required by the engine and the ignition controllability is degraded.

Therefore, it is necessary to dispose an apparatus capable of self-diagnosing the leakage of air and making a correction according to the leakage quantity when the leakage of air occurs. However, according to the conventional technique, even if the air-fuel ratio is detected based on the oxygen concentration in the exhaust gas of the engine, since it is impossible to distinguish whether or not the mean deviation of the air-fuel ratio detected is due to the leakage of air into the suction system of the engine, once the mean deviation of the air-fuel ratio is detected, all of electric appliances participating in the control of the air-fuel ratio (a control unit, an air flow meter, a fuel injection valve and the like) are exchanged with new ones.

More specifically, in some electronically controlled fuel supply apparatus, the air-fuel ratio in the air-fuel mixture sucked in the engine is detected through the oxygen concentration in the exhaust gas, and an air-fuel ratio feedback correction function of performing the feedback correction of the basic fuel supply quantity so that the detected air-fuel ratio is brought close to the target air-fuel ratio is given. This function is adjusted so that the correction quantity by the air-fuel ratio feedback correction is minute at the initial stage. If a large correction by the air-fuel ratio feedback control becomes necessary afterward, when the correction is one for increasing the quantity of the fuel, there is a possibility that the detected value of the sucked air flow quantity is made smaller than the true value because of the leakage of air. In this case, however, the deviation cannot be distinguished from the deviation of the air-fuel ratio which is due to the degradation of supply characteristics of a fuel injection valve for supplying the fuel or the trouble of the air flow meter the pressure regulator for adjusting the fuel supply pressure. Therefore, it is necessary to exchange all of the related parts and find out the part causing the deviation. Accordingly, the maintenance characteristics for coping with the leakage of air are poor.

SUMMARY OF THE INVENTION

The present invention has been completed to solve the foregoing problems, and it is a primary object to provide a method and apparatus in which occurrence of the leakage of air into the suction system of an engine is self-diagnosed and the engine controllability is maintained by making a correction coping with the leakage of air based on the result of the self-diagnosis.

Another object of the present invention is to provide a method and apparatus in which occurrence of the leakage of air into the suction system of an engine is diagnosed while distinguishing it from the change in fuel supply characteristics and the reliability of the diagnosis of the leakage of air is increased.

In accordance with the present invention, the foregoing objects can be attained by a method for the self-diagnosis of the leakage of air in a control system of an internal combustion engine, in which a flow quantity of air sucked in the internal combustion engine is detected and an engine control quantity including at least a quantity of a fuel to be supplied into the engine is set based on the detected air flow quantity, said method comprising setting an air-fuel ratio correction value for correcting the fuel supply quantity set based on the detected value of the sucked air flow quantity so that the air-fuel ratio in an air-fuel mixture sucked into the engine, which is detected through the detection of an exhaust component of the engine, is brought close to a target air-fuel ratio, wherein when there is observed a tendency that the proportion of the correction of the fuel supply quantity by the set air-fuel ratio correction value increases in a correction-increasing direction in a driving region having a smaller sucked air flow quantity, it is judged that the leakage of air into the suction system of the engine occurs.

In a region having a smaller sucked air flow quantity, the proportion of the leaking air quantity in the entire sucked air quantity is larger and the air-fuel ratio is made leaner in this region. Accordingly, the proportion of the correction of the air-fuel ratio by the air-fuel correction value for correction of this leaning of the air-fuel ratio increases in the fuel quantity-increasing direction in the region having a smaller sucked air flow quantity, and therefore, the leaning of the air-fuel ratio can be judged.

This method is constructed so that when occurrence of the leakage of air into the suction system of the engine is judged, the quantity of correction of the sucked air flow quantity, corresponding to the quantity of leaking air, is learned based on the above-mentioned air-fuel ratio correction value and the sucked air flow quantity corresponding to said air-fuel ratio correction value, and the detected value of the sucked air flow quantity corresponding to the quantity of leaking air is corrected based on this correction quantity of the sucked air flow quantity and the corrected value is used for setting the engine control quantity. If this structure is adopted, the engine control quantity can be set based on the sucked air flow quantity while taking the quantity of leaking air into consideration, and the engine controllability can be maintained at a high level.

Moreover, the method is constructed so that the air-fuel ratio in one specific cylinder among a plurality of cylinders is forcibly changed by a predetermined value by correction of the fuel supply quantity for said specific cylinder, the difference of the air-fuel ratio correction value before and after said change of the air-fuel ratio is detected, and the correction value of the fuel supply quantity in said specific cylinder is set so that said difference of the air-fuel ratio correction value is brought close to a predetermined target value corresponding to the change of the air-fuel ratio, whereby the quantity of correction of the fuel supply quantity for correcting the fuel supply characteristic in each cylinder is learned. If this structure is adopted, the self-diagnosis of the leakage of air can be accomplished while correcting the fuel supply quantity for each cylinder based on said correction quantity of the fuel supply quantity.

Thus, according to the method of the present invention, the self-diagnosis of the leakage of air is accomplished while compensating the change of the air-fuel ratio by the change of the fuel supply characteristics.

Furthermore, the foregoing objects of the present invention can be attained by an apparatus for the self-diagnosis of the leakage of air in a control system of an internal combustion engine, in which sucked air flow quantity-detecting means is disposed to detect the flow quantity of air sucked in the engine and an engine control quantity including at least a quantity of a fuel to be supplied into the engine is set based on the detected air flow quantity, said apparatus comprising air-fuel ratio-detecting means for detecting an exhaust component of the engine and detecting the air-fuel ratio of an air-fuel mixture sucked in the engine based on the detected exhaust component, air-fuel ratio correction value-setting means for setting an air-fuel ratio correction value for correction of the fuel supply quantity based on the detected value of the quantity of sucked air so that the air-fuel ratio detected by said air-fuel ratio-detecting means is brought close to a target air-fuel ratio, and air leakage-judging means for judging occurrence of the leakage of air into the suction system of the engine when there is observed a tendency that the proportion of the correction by the air-fuel ratio correction value set by said air-fuel ratio correction value-setting means increases in a correction-increasing direction in a driving region having a smaller sucked air flow quantity.

The control system of an internal combustion engine, to which the present invention is applied, comprises sucked air flow quantity-detecting means for detecting the flow quantity of air sucked in the engine, and the control system is constructed so that an engine control quantity including at least a fuel supply quantity is set based on the sucked air flow quantity detected by this detecting means.

In the apparatus for the self-diagnosis of the leakage of air according to the present invention, the air-fuel ratio-detecting means detects an exhaust component of the engine and detects the air-fuel ratio of an air-fuel mixture sucked in the engine based on the detected exhaust component. The air-fuel ratio correction value-setting means sets an air fuel ratio correction value for correcting the fuel supply quantity based on the detected value of the sucked air flow quantity so that the air-fuel ratio detected by the air-fuel ratio-detecting means is brought close to a target air-fuel ratio.

The air leakage-judging means judges occurrence of the leakage of air into the suction system of the engine where there is observed a tendency that the proportion of the correction by the set air-fuel correction value increases in a correction-increasing direction in a driving region having a smaller sucked air flow quantity.

More specifically, when the leakage of air takes place, if the flow quantity of sucked air is large, the proportion of the quantity of leaking air to the true air quantity is small and the deviation of the air-fuel ratio is therefore small. In contrast, if the flow quantity of sucked air is small, the proportion of the quantity of leaking air to the true air quantity increases and therefore, a large deviation of the air-fuel ratio is brought about. If the air-fuel ratio is made lean by occurrence of the air leakage, the air-fuel ratio correction value increases the fuel supply quantity for compensating this leaning, and therefore, in a driving region having a smaller flow quantity of sucked air, the proportion of the increase correction by the air-fuel ratio correction value becomes larger, with the result that the proportion of this increase correction is in agreement with the deviation of the air-fuel ratio by the leakage of air and the leakage of air can be indirectly judged.

In the apparatus for the self-diagnosis of the leakage of air having the above-mentioned structure, there are further disposed leakage correction quantity-setting means for setting the quantity of correction of sucked air flow quantity corresponding to the quantity of leaking air based on the air-fuel ratio correction value and the sucked air flow quantity corresponding to said air-fuel ratio correction value when occurrence of the leakage of air is judged, and sucked air flow quantity-learning correcting means for correcting the sucked air flow quantity detected by the sucked air flow quantity-detecting means based on the correction quantity set by said leakage correction quantity-setting means and setting the engine control quantity based on the result of said correction.

More specifically, when occurrence of the leakage of air judged, the leakage correction quantity-setting means sets the correction quantity of the sucked air flow quantity corresponding to the quantity of leaking air based on the air-fuel ratio correction value and the sucked air flow quantity corresponding to the air-ratio correction value. The sucked air flow quantity-learning correcting means corrects the sucked air flow quantity detected by the sucked air flow quantity-detecting means based on the correction quantity set by the leakage correction quantity-setting means and sets the engine control quantity based on the result of this correction.

When the air leakage is caused, in a driving region having a smaller sucked air flow quantity, the proportion of the increase correction by the air-fuel correction value becomes larger, and the deviation of the air-fuel by the leakage of air is corrected by the air-fuel ratio correction value. Accordingly, the quantity of leaking air can be estimated by the air-fuel ratio correction value, and by correcting the detected value by this estimated value, the quantity of leaking air is included in the sucked air flow quantity used for setting the engine control quantity.

Preferably, the apparatus further comprises means for learning the correction value for each cylinder, which is disposed to forcibly correct only the fuel supply quantity of specific one cylinder among a plurality of cylinders and change only the air-fuel ratio of said specific one cylinder, detect the difference of the air-fuel ratio correction value set by the air-fuel ratio correction value-setting means before and after said forcible correction, compare the detected difference with a predetermined expected value of said difference, and set the correction value of the fuel supply quantity of said specific one cylinder so that said difference is brought close to the predetermined expected value, whereby the correction value of the fuel supply quantity for each cylinder is learned.

By forcibly correcting only the fuel supply quantity of specific one cylinder among a plurality of cylinders to change only the air-fuel ratio of said specific one cylinder, detecting the difference of the air-fuel ratio correction value set by the air-fuel ratio correction value-setting means before and after said forcible correction, comparing the detected difference with a predetermined expected value of the difference and setting the correction value of the fuel injection quantity of said specific one cylinder so that said difference is brought close to the predetermined expected value, said means for learning the correction value for each cylinder learns the correction values of the fuel supply quantity for the respective cylinders and cancels the deviations of the air-fuel ratio among cylinders, which are due to uneven fuel supply characteristics in the respective cylinders, whereby the target air-fuel ratio can be obtained in each cylinder.

In the case where there is a change of fuel supply characteristics and a predetermined quantity of a fuel based on a control signal cannot be obtained, it sometimes happens that there is observed a tendency that in a driving region having a smaller sucked air flow quantity (or a smaller fuel supply control quantity), the proportion of the increase correction by the air-fuel correction value becomes larger, that is, a tendency resembling the above-mentioned tendency of the deviation of the air-fuel ratio. Also in this case, it is impossible to distinguish whether the deviation of the air-fuel ratio is due to the change of the fuel supply characteristics or the leakage of air. Accordingly, by disposing the above-mentioned means for learning the correction value for each cylinder, the deviation of the air-fuel ratio by the change of the fuel supply characteristics is cancelled and the cause of the deviation of the air-fuel ratio is limited to the leakage of air.

The present invention will now be described in detail with reference to one embodiment illustrated in the accompanying drawings.

DETAILED DESCRIPTION OF THE PREFERRED EMBODIMENT

Figure 1:
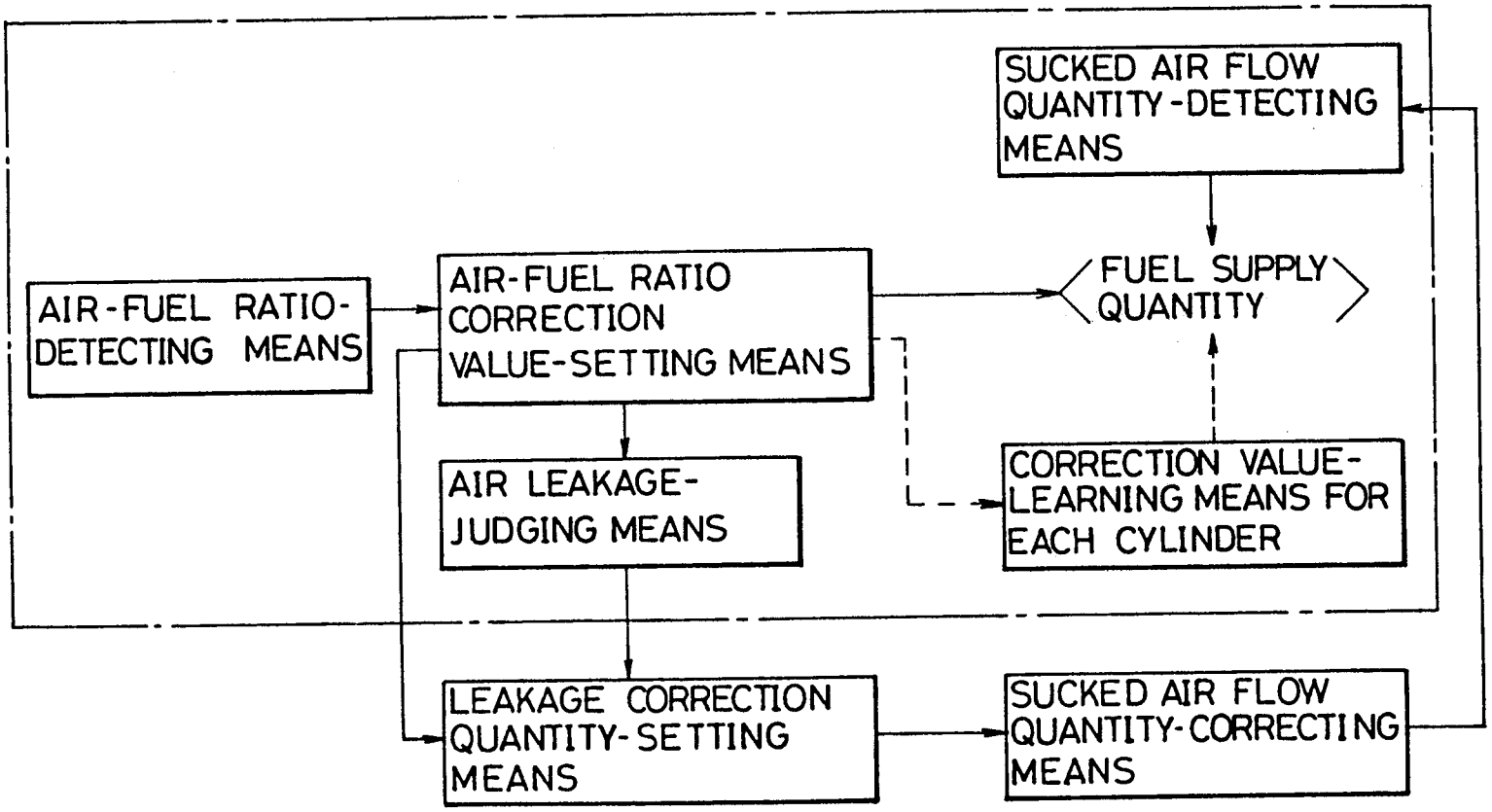
FIG. 1 is a block diagram illustrating the structure of the present invention.

The outline of the present invention is as shown in FIG. 1, and one embodiment is illustrated in FIGS. 2 through 9.

Figure 2:
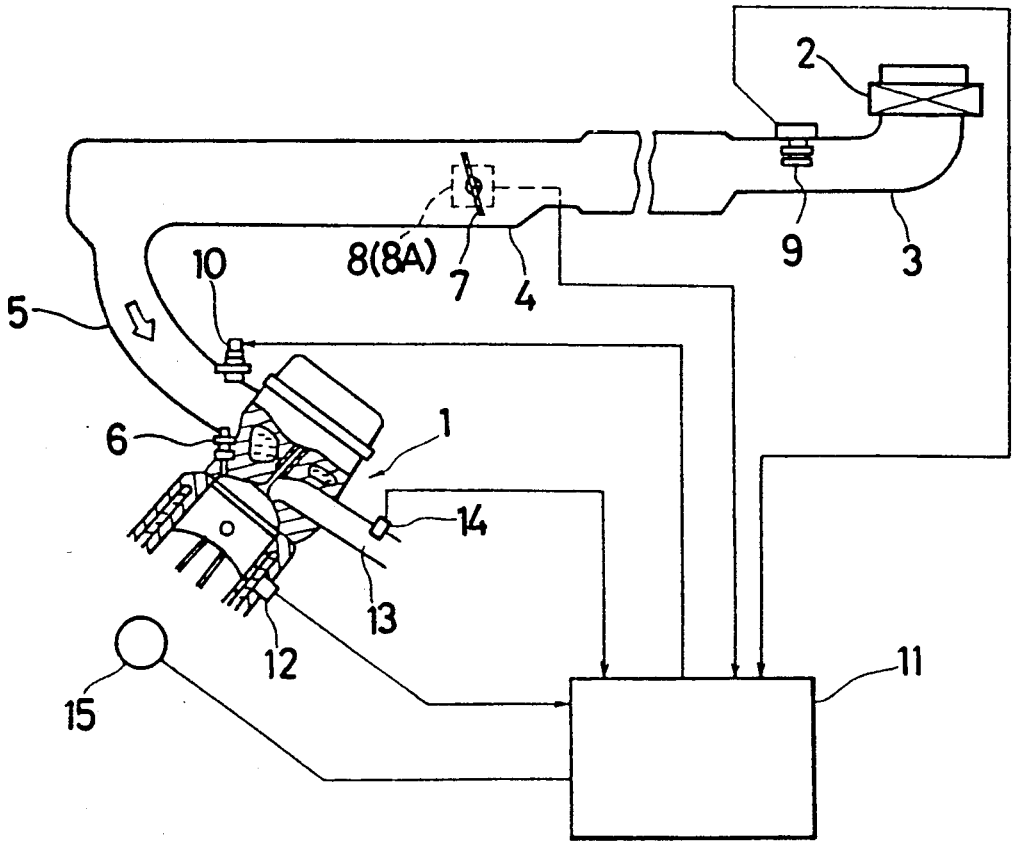
FIG. 2 is a system diagram illustrating one embodiment of the present invention.

Referring to FIG. 2, air is sucked into an internal combustion engine 1 through an air cleaner 2, a suction duct 3, a throttle chamber 4 and a suction manifold 5. A throttle valve 7 for variably controlling the open area of the throttle chamber 4 in co-operation with an accelerator pedal not shown in the drawings is disposed in the throttle chamber 4 to control the sucked air flow quantity Q.

A throttle sensor 8 comprising a potentiometer for detecting the opening degree TVO of the throttle valve 7 and an idle switch 8A to be turned on at the wholly closed position (idle position) of the throttle valve 7 is attached to the throttle valve 7.

An air flow meter 9 as the sucked air flow quantity-detecting means for detecting the sucked air flow quantity Q of the engine 1 is disposed in the suction duct 3 upstream of the throttle valve 7 to put out a voltage signal Us corresponding to the sucked air flow quantity Q.

Electromagnetic injection valves 10 for respective cylinders are arranged at respective branches of the suction manifold 5 arranged downstream of the throttle valve 7. Each fuel injection valve 10 is driven and opened by a driving pulse signal put out at a timing synchronous with the revolution of the engine from a control unit 11 having, installed therein, a microcomputer described hereinafter, to inject and supply a fuel fed under a pressure from a fuel pump not shown in the drawings and maintained under a predetermined pressure by a pressure regulator into the suction manifold 5. Namely, the quantity of the fuel supplied by the fuel injection valve 10 is controlled by the opening time of the fuel injection valve 10.

Furthermore, a water temperature sensor 12 is arranged to detect the temperature of cooling water in a cooling jacket of the engine 1, and an oxygen sensor 14 is arranged as the air-fuel ratio-detecting means for detecting the air-fuel ratio of an air-fuel mixture sucked in the engine by detecting the oxygen concentration in the exhaust gas in an exhaust pass. Moreover, an ignition plug 6 is exposed into a combustion chamber of each cylinder.

The control unit 11 detects a revolution speed N of the engine by counting crank unit angle singles POS put out synchronously with the revolution of the engine from a crank angle sensor 15 for a certain time or measuring the frequency of crank reference angle signals REF put out at every predetermined crank angle position (at every 180° in case of a 4-cylinder engine).

The fuel supply control including the self-diagnosis of the leakage of air, which is performed by the control unit 11, will now be described with reference to routines shown in flow charts of FIGS. 3 through 7.

In the present embodiment, the functions of air-fuel ratio feedback correction value-setting means, air leakage-judging means, leakage correction quantity-setting means, sucked air flow quantity-learning correcting means and correction value-learning means for each cylinder are arranged as soft wares as shown in the flow charts of FIGS. 3 through 7.

Figure 3:
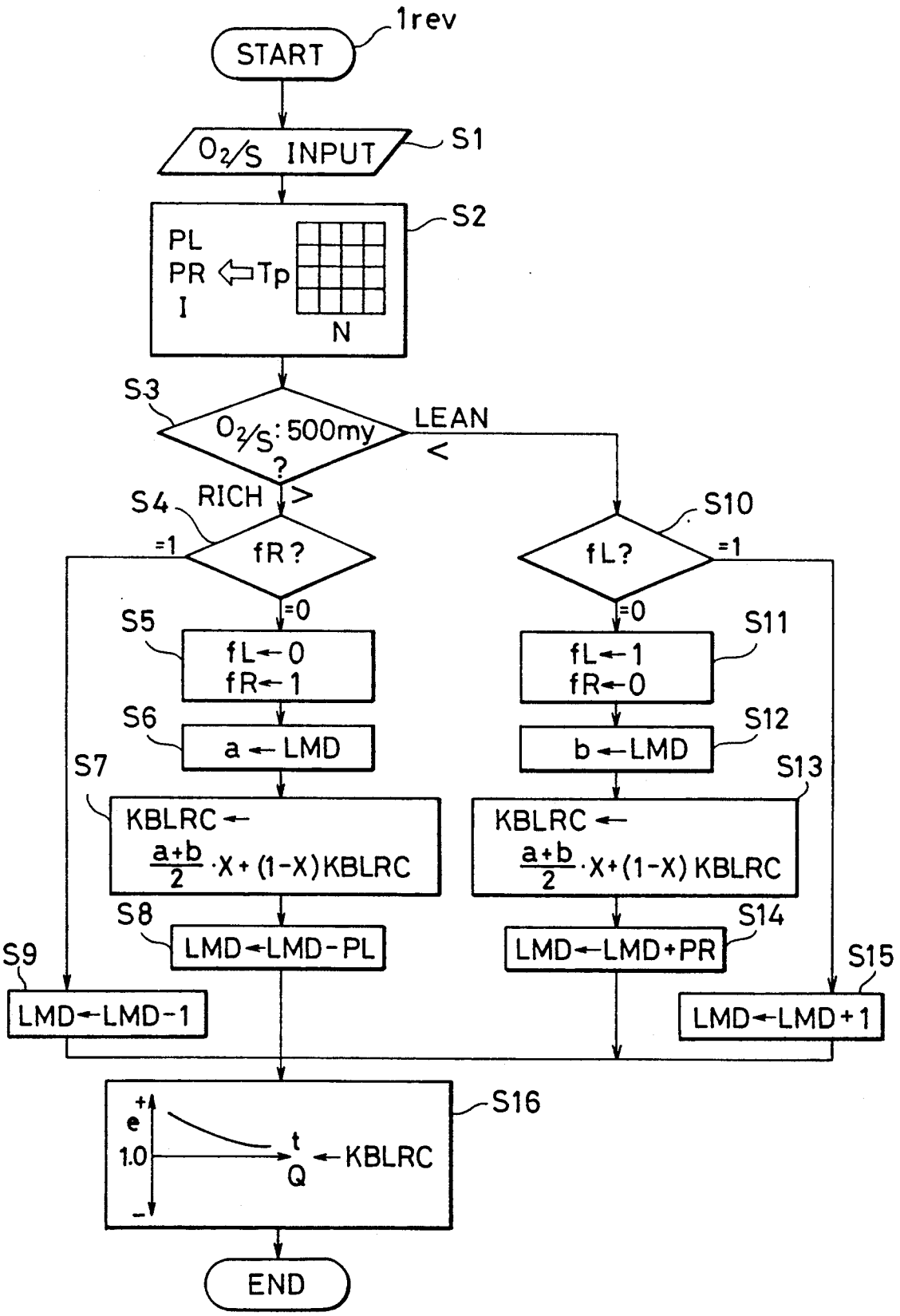
FIGS. 3 through 7 are flow charts showing the control contents in the embodiment shown in FIG. 2.

The routine shown in the flow chart of FIG. 3 is a routine for setting a coefficient LMD of the air-fuel ratio feedback correction practiced at every revolution of the engine (air-fuel ratio feedback correction value). The air-fuel ratio feedback correction coefficient LMD is a coefficient for correcting the basic fuel injection quantity Tp so that the air fuel ratio (average air-fuel ratio in the respective cylinders) of the sucked air-fuel mixture detected by the oxygen sensor 14 is brought close to a target air-fuel ratio (theoretical air-fuel ratio), and in the present embodiment, the coefficient LMD is controlled as the reference value of 1.0 by the proportion-integration control.

At first, at step 1 (indicated as S1 in the drawings; subsequent steps are similarly indicated), the output voltage of the oxygen sensor ($O_2$/S) 14 is put into the control unit.

At step 2, the operation quantity for the proportion-integration control of the air-fuel ratio feedback correction coefficient LMD is retrieved and determined according to the present driving state from a map where operation quantities of respective driving states are stored in advance. In the present embodiment, lean control proportion component PL, rich control proportion component PR and integration component I for each driving state classified by the engine revolution number N and the basic fuel injection quantity Tp ($=K\times Q/N$ in which K is a constant) are stored, and the operation quantity corresponding to the present driving state is retrieved from the present basic fuel injection quantity Tp and engine revolution number N.

At subsequent step 3, the output of the oxygen sensor 14 put into the control unit at step 1 is compared with the slice level corresponding to the target air-fuel ratio, and it is judged whether the actual air-fuel ratio is rich or lean as compared with the target air-fuel ratio.

When it is judged that the actual air-fuel ratio is rich as compared with the target air-fuel ratio, the routine goes into step 4 and judgment of rich flag fR is carried out. As described hereinafter, zero is set at rich flag fR when the lean air-fuel ratio is first detected. Accordingly, if the rich air-fuel ratio is first detected at step 3, it is judged that rich flag fR is set at 0.

If at the a first detection of the rich air-fuel ratio, it is judged that the rich flag fR is set at zero, the routine goes into step 5 and the rich flag fR is set at 1 while the lean flag fL is set at 0.

At subsequent step 6, the maximum value of the present air-fuel ratio feedback correction coefficient LMD, that is the air-fuel ratio feedback correction coefficient controlled and increased during the lean state of the air-fuel ratio, is set at a.

At subsequent step 7, when the minimum value b of the air-fuel ratio feedback correction coefficient LMD is set at the first detection of the lean air-fuel ratio as described hereinafter, the air-fuel ratio-learning correction coefficient KBLTC is computed based on this minimum value b and the above-mentioned maximum value a according to the following equation:

$$KBLRC \leftarrow [(a+b)/2] \cdot \times + (1-X)KBLRC$$

In the above calculation equation, $(a+b)/2$ represents the median of the air-fuel ratio feedback correction coefficient LMD. The median corresponding to the correction coefficient for obtaining this target air-fuel ratio is weight-averaged by using the precedent air-fuel ratio-learning correction coefficient KBLRC and the weight X, and the new air-fuel ratio-learning correction coefficient is set. Accordingly, the air-fuel ratio-learning correction coefficient KBLRC is a correction coefficient to be learned for obtaining the target air-fuel ratio without using the air-fuel ratio feedback correction coefficient LMD.

At subsequent step 8, the proportion component PL of the lean control retrieved at step 2 is subtracted from the precedent air-fuel ratio feedback correction coefficient LMD, and the rich state is canceled by the reduction control of the air fuel ratio feedback correction coefficient LMD.

At subsequent step 12, the minimum value of the air-fuel ratio feedback correction coefficient decrease-controlled in the rich air-fuel ratio state is set at b.

At the time of continuation of the detection of the rich state when it is judged at step 4 that the rich flag fR is at 1, the routine goes into step 9, and by subtracting the integration component I retrieved from the map at step 2 from the precedent the air-fuel ratio feedback correction coefficient LMD, the air-fuel ratio feedback correction coefficient LMD is gradually reduced until the rich state of the air-fuel ratio is canceled.

When it is judged at step 3 that the air-fuel ratio is lean, the routine goes into step 10, the discrimination of the lean flag fL is carried out. Since the lean flag fL is set at zero at step 5 at the first detection of the lean air-fuel ratio as described hereinbefore, if the lean air-fuel ratio is detected, at this step 10, it is judged that the lean flag fL is set at zero.

At the first detection of the lean air-fuel ratio, the routine goes into step 11, and the lean flag fL is set at 1 and the rich flag fR is set at zero.

At subsequent step 13, the air-fuel ratio-learning correction coefficient KBLR is computed by using the minimum value b set at the present run at step 12 and the maximum value a set at step 6, in the same manner as at step 7.

At subsequent step 14, the air-fuel ratio feedback correction coefficient LMD is increased and corrected by adding the proportion component PR of the rich control retrieved at step 2 to the precedent air-fuel ratio feedback correction coefficient LMD.

If it is judged at step 10 that the lean flag fL is at 1, that is, if the detection of the lean air-fuel ratio is continued, the routine goes into step 15, and by adding the integration proportion I retrieved at step 2 to the precedent value of the air-fuel ratio feedback correction coefficient LMD, the air-fuel ratio feedback correction coefficient LMD is gradually increased until the lean state of the air-fuel ratio is cancelled.

The air-fuel ratio feedback correction coefficient LMD is set by the proportion-integration control conducted in the above-mentioned manner, and when the air-fuel ratio-learning correction coefficient KBLR is computed based on said air-fuel ratio feedback correction coefficient LMD, at subsequent step 16, the air-fuel ratio-learning correction coefficient KBLRC is stored in the map according to the sucked air flow quantity Q.

Since the air-fuel ratio-Learning correction coefficient KBLRC is set so that the actual air-fuel ratio is controlled to the target air-fuel ratio without using the air-fuel ratio feedback correction coefficient LMD, if the target air-fuel ratio is obtained without the correction of the air-fuel ratio by the air-fuel ratio feedback correction coefficient LMD, the air-fuel ratio-learning correction coefficient KBLRC is learned and set substantially at the reference value of about 1.0. Accordingly, as the air-fuel ratio-learning correction coefficient KBLRC (air-fuel ratio correction value) deviates from the reference value of 1.0, a correction proportional to the degree of this deviation is made, and if this correction ratio r (the deviation from the reference value of 1.0 in the positive or negative direction) is stored, it is judged how the correction proportion is changed according to the change of the sucked air flow quantity Q, and the map of this correction proportion is verified according to the routine shown in the flow chart of FIG. 4.

Figure 4:
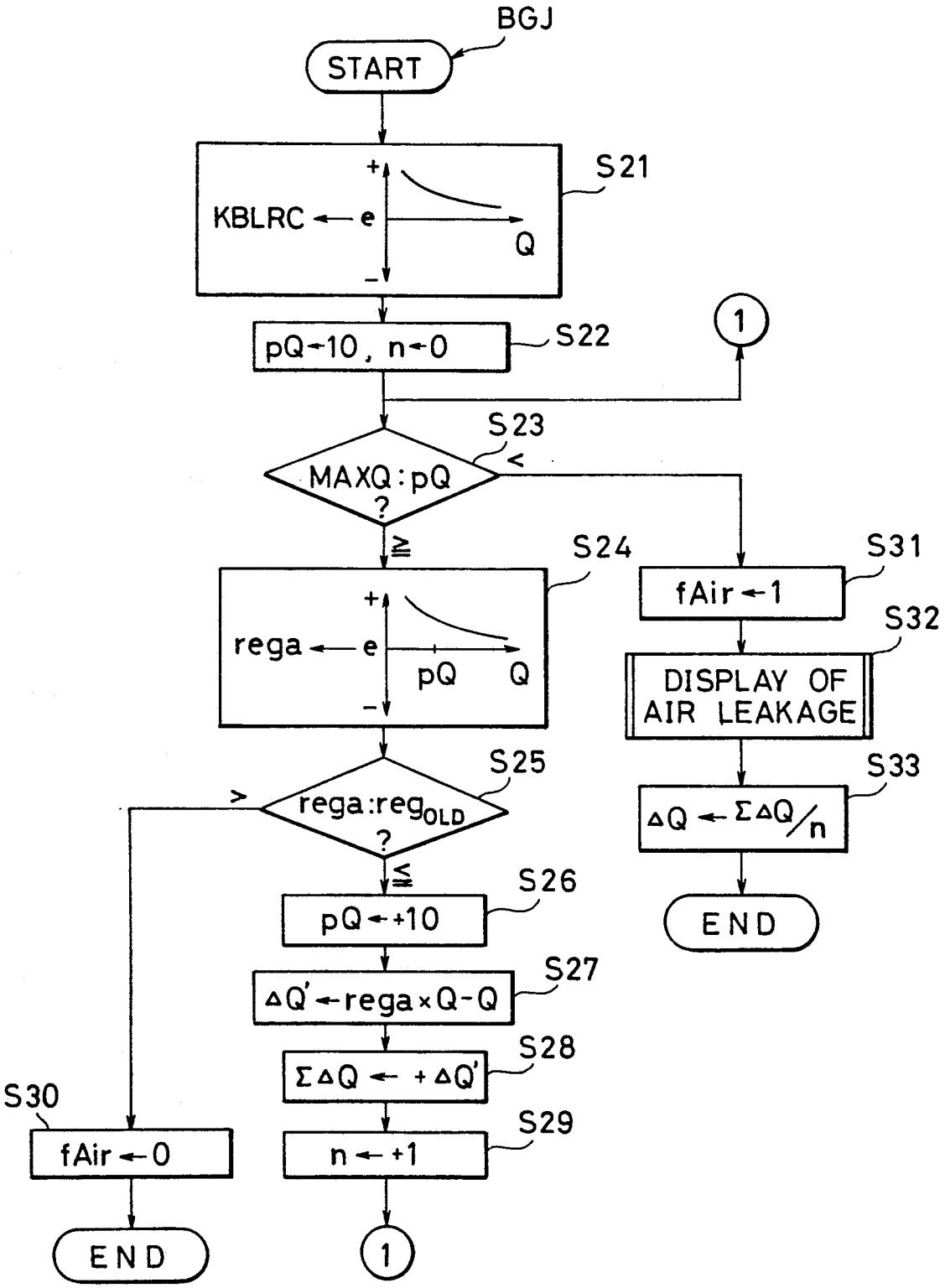

The routine shown in the flow chart of FIG. 4 is of a background processing. At first, at step 21, the data of the air-fuel ratio-learning correction coefficient KBLRC corresponding to the present sucked air flow quantity is retrieved and determined from the map of the correction proportion e set at step 16, and the air-fuel ratio-learning correction coefficient KBRLC to be used for the calculation of the fuel injection quantity Ti is set.

At subsequent step 22, the minimum value of 10 (kg/h) is set for the data pQ of the sucked air flow quantity Q for sampling the correction proportion e when in the map of the correction proportion e, it is detected how the correction proportion e is changed according to the change of the sucked air flow quantity, and the count value n of the sampling number is reset at zero.

Then, at step 23, the pQ value which is increased by 10 every time the correction proportion e is sampled is compared with the predetermined maximum value MAXQ, and if the pQ value is smaller than the maximum value MAXQ, the routine goes into step 24.

At step 24, the data corresponding to the pQ value is retrieved and determined from the map of the correction proportion e stored according to the sucked air flow quantity and retrieved value is set at rega.

At next step 25, the data rega presently retrieved at step 24 is compared with the precedent retrieved data $rega_{old}$, and if the precedent retrieved data $rega_{old}$ is larger than the presently retrieved value, the routine goes into step 26.

At step 26, the pQ value which is the data of the sucked air flow quantity for sampling the correction proportion e is corrected by adding 10 to the pQ value, so that the data corresponding to the sucked air flow quantity larger by 10 kg/h than the sucked air flow quantity Q corresponding to the data of the correction proportion e presently retrieved at step 24 will be next retrieved.

At next step 27, the error quantity $\Delta Q'$ of the value detected by the air flow meter is set by subtracting the sucked air flow quantity Q from the value obtained by multiplying rega, at which the correction proportion e presently retrieved at step 24 is set, by the sucked air flow quantity.

Namely, since the target air-fuel ratio is obtained by multiplying the basic fuel injection quantity Tp ($=K\times Q/N$, in which K is a constant) by the air-fuel ratio-learning correction coefficient KBLRC set at rega, if the sucked air flow quantity Q detected by the air flow meter 9 is multiplied by the air-fuel ratio-learning correction coefficient KBLRC, the sucked air flow quantity is corrected to the true value. Therefore, the error quantity of the air flow meter 9 is detected by subtracting the detected value from the true sucked air flow quantity Q.

At next step 28, the detection error quantity $\Delta Q'$ of the air flow meter 9 is integrated, and at next step 29, the count number of the integrated detection error quantity $\Delta Q'$ is increased by one.

Then, the routine returns to step 23, and while it is judged at step 25 that the precedent retrieved value $rega_{old}$ is larger than the presently retrieved value rega, the computation of the error quantity $\Delta Q'$ is repeated until it is judged at step 23 that the pQ value which is the sucked air flow quantity to be sampled exceeds the maximum value MAXQ.

In the case where the correction proportion by the air-fuel ratio-learning correction coefficient KBLRC is in the increasing direction and the correction proportion is larger in a region of a smaller sucked air flow quantity Q, the routine goes into step 26 from step 25 until the pQ value is increased to MAX0 from 10, whereby the computation of the error quantity $\Delta Q'$ based on the air-fuel ratio-learning correction coefficient KBLRC (rega) is carried out over the entire region of the sucked air flow quantity Q.

Figure 8:
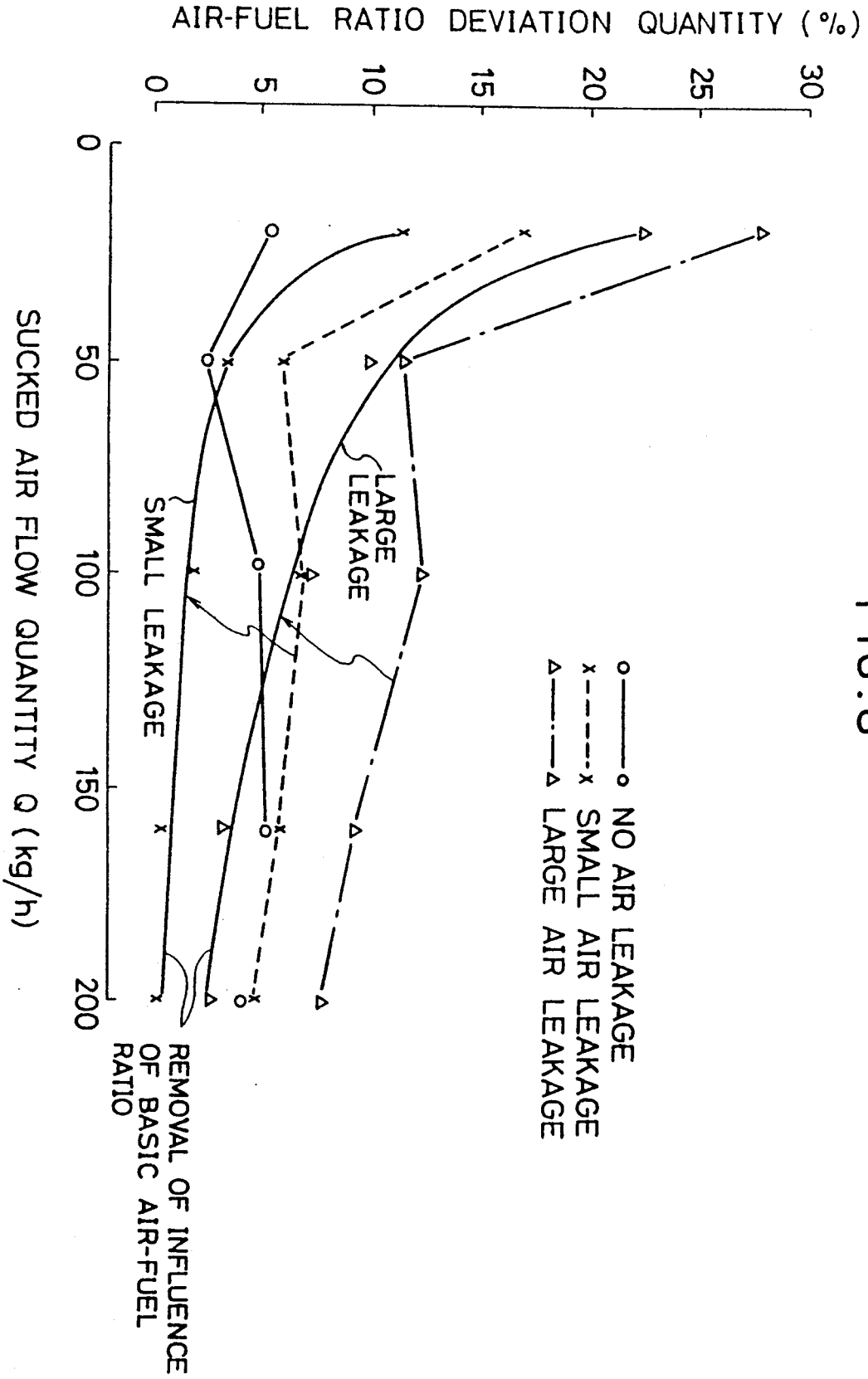
FIG. 8 is a graph showing the level of the deviation of the air-fuel ratio relatively to the sucked air flow quantity at the time of occurrence of the air leakage.

The tendency that if the correction proportion by the air-fuel ratio-learning correction coefficient KBLRC is in the increasing direction, the correction proportion is larger in a region where the sucked air flow quantity Q is smaller is the same as the tendency observed when the leakage of air into the cylinder, not through the air flow meter, is caused, as shown in FIG. 8.

Namely, if the air leakage occurs, the detection value of the air flow meter 9 is smaller by the quantity of leaking air than the true value, and if the fuel injection valve 10 is driven and controlled by the basic fuel injection quantity Tp based on this detection value of the sucked air flow quantity Q, the air-fuel ratio is leaned. In order to overcome this leaning, the air-fuel ratio feedback correction coefficient LMD is increased and controlled from the reference value of 1.0, and the air-fuel ratio-learning correction coefficient KBLRC is learned as a value larger than the reference value of 1.0.

In the case where the sucked air flow quantity Q is large, since the proportion of the quantity of leaking air in the entire sucked air flow quantity Q is small, a large proportion of the correction by the air-fuel ratio feedback correction coefficient becomes unnecessary. In contrast, if the sucked air flow quantity is small, the proportion of the quantity of leaking air in the entire sucked air flow quantity becomes large, a large proportion of the correction by the feedback correction coefficient LMD becomes necessary.

Accordingly, if at steps 23 through 29 in the flow chart of FIG. 4, there is observed a tendency that the proportion of the correction by the air-fuel ratio-learning correction coefficient KBLRC is in the increasing direction and the correction proportion is increased in a region where the sucked air flow quantity Q is smaller, occurrence of the leakage of air can be foreseen and judged. In this case, the routine goes into step 31.

At step 31, the flag fAir for judging occurrence of the air leakage is set at 1 so that the occurrence of the air leakage can be judged by this flag fAir, and at next step 32, occurrence of the air leakage is displayed, for example, on a dash-board of a vehicle or the like to let a driver know that the maintenance operation at a maintenance factory is required.

At step 33, the error quantity $\Delta Q'$ integrated at step 28 is divided by the sampling number n and the average value $\Delta Q$ of the error quantity $\Delta Q'$ is determined. The detection value of the air flow meter 9 is corrected based on the computed average value $\Delta 0$, that is, the correction quantity corresponding to the quantity of leaking air, so that the basic fuel injection quantity Tp can be calculated by the sucked air flow quantity Q including the quantity of leaking air.

In the case where the air-fuel ratio-learning correction coefficient KBLRC is not gradually increased according to the decrease of the sucked air flow quantity Q and it is judged at step 25 that rega is Larger than $rega_{old'}$ since the tendency is different from the tendency observed when the air leakage takes place, the routine goes into step 30 without performing the judgment of occurrence of the air leakage, and setting of the flag fAir at zero indicates the state where the air leakage does not occur.

If the change of the correction proportion of the air-fuel ratio according to the change of the sucked air flow quantity is detected in the above-mentioned manner, occurrence of the leakage of air into the suction system of the engine 1 can be self-diagnosed at a high precision, and therefore, the deviation of the air-fuel ratio caused by the air leakage can be discriminated and the maintenance can be facilitated.

The correction control of the sucked air flow quantity Q based on the above-mentioned $\Delta Q$ value will now be described with reference to the routine shown in the flow chart of FIG. 5.

Figure 5:
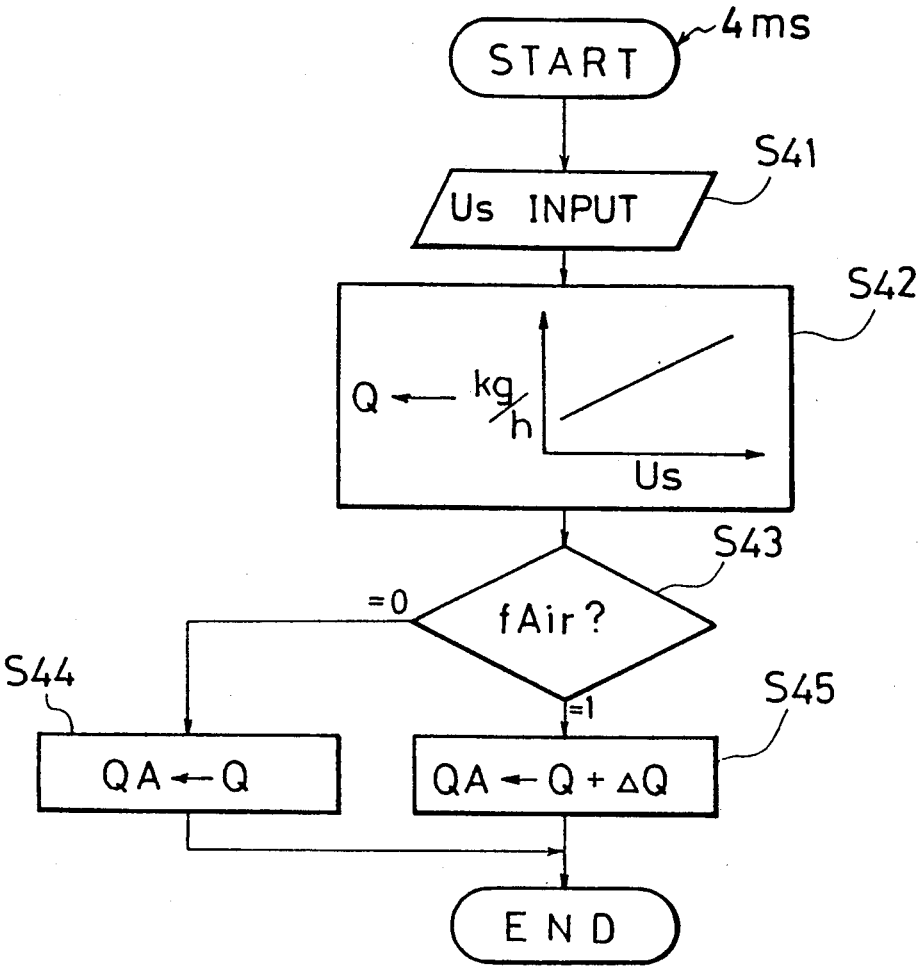

The routine shown in the flow chart of FIG. 5 is practiced at every minute time (4 ms). At first, at step 41, a voltage signal put out from the air flow meter 9 according to the sucked air flow quantity Q is put into the control unit.

Then, at next step 42, the sucked air flow quantity Q corresponding to the voltage signal Us presently received is retrieved and determined from a map in which data of the sucked air flow quantity corresponding to the voltage signal Us have been stored in advance.

At next step 43, the state of the flag fAir set by the routine shown in the flow chart of FIG. 4 is discriminated, and in the state where the flag fAir is at zero and occurrence of the air leakage is not detected, the routine goes into step 44. At step 44, the sucked air flow quantity Q is set as the final sucked air flow quantity QA, and the value detected by the air flow meter 9 is set as the final value.

If it is judged at step 43 that the flag fAir is at 1, since it is judged that the air leakage occurs, the value detected by the air flow meter 9 is smaller by the quantity of leaking air than the true quantity of air. Accordingly, the value obtained by adding the error quantity $\Delta Q$ corresponding to the quantity of leaking air computed by the routine shown in the flow chart of FIG. 4 is set as the final sucked air flow quantity QA.

Figure 6:
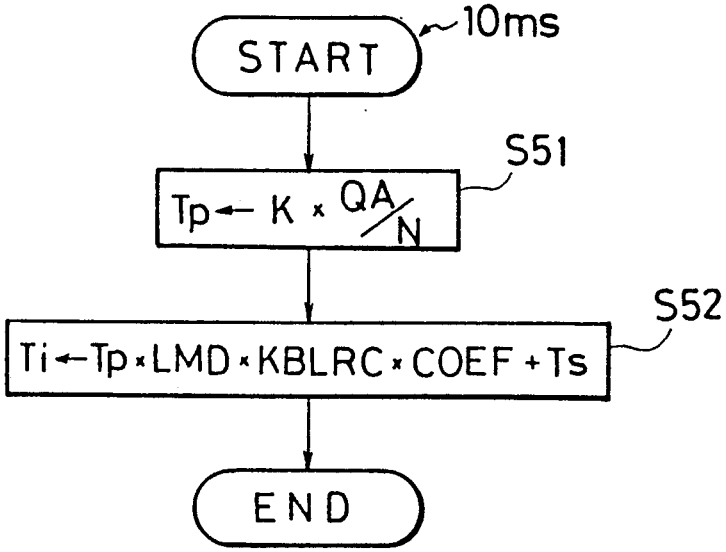

If the correction by addition of $\Delta Q$ is thus changed over acoording to the presence or absence of the air leakage to set the final sucked air flow quantity QA, the computation of the fuel supply quantity by using this sucked air flow quantity QA is carried out according to the routine shown in the flow chart of FIG. 6.

The routine shown in the flow chart of FIG. 6 is carried out at every predetermined time (for example, 10 ms). At first, at step 51, the basic fuel injection quantity Tp ($\leftarrow K \times Q/N$, in which K is a constant) is computed based on the sucked air flow quantity and the engine revolution speed N.

At next step 52, various corrections are made to the basic fuel injection quantity Tp computed at step 51 according to the driving state to compute the final fuel injection quantity Ti by the following equation:

$$Ti \leftarrow Tp \times LMD \times KBLRC \times COEF + Ts$$

In the above equation, LMD represents the air-fuel ratio feedback correction coefficient obtained through the proportion-integration control according to the routine shown in the flow chart of FIG. 3, KBLRC represents the air-fuel ratio-learning correction coefficient learned and set based on the air-fuel ratio feedback correction coefficient LMD according to the routine shown in FIG. 3, COEF represents various correction coefficients set based mainly on the cooling water temperature Tw detected by the water temperature sensor 12, and Ts represents the quantity of the correction for cancelling the change of the effective valve-opening time (delay of the valve-opening time) caused by the change of the voltage of a battery as the driving power source for the fuel injection valve.

The thus computed fuel injection quantity Ti is set at an output register of the microcomputer, and at a predetermined injection-starting timing, a driving pulse signal having a pulse width corresponding to the newest fuel injection quantity Ti set at this output register is put out to the fuel injection valve 10, and intermittent injection supply by the fuel injection valve 10 is controlled.

If the self-diagnosis of the air leakage is carried out in the above-mentioned manner, the correction corresponding to the quantity of leaking air is made to the detected value of the sucked air flow quantity Q, and the basic fuel injection quantity Tp is computed based on this corrected sucked air flow quantity Q. Therefore, the fuel controllability at the time of occurrence of the air leakage is improved, and for example, in the case where the ignition timing (ignition advance value) is controlled based on the basic fuel injection quantity Tp and the engine revolution number N, even if there occurs the leakage of air, the required ignition timing setting is accomplished and the ignition timing controllability can be improved.

Figure 9:
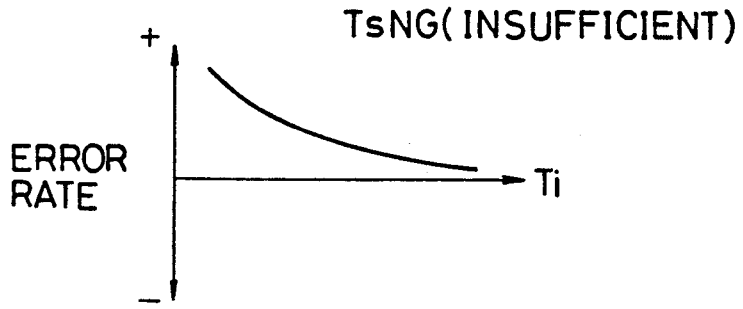
FIG. 9 is a graph illustrating the error rate of the air fuel control observed at an insufficient correction of the delay of opening or closing of the fuel injection valve.

For example, if the voltage correction quantity Ts used for the computation of the fuel injection quantity Ti becomes inadequate because of deterioration of the fuel injection valve 10 or the like, as shown in FIG. 9, the air-fuel ratio error becomes larger in a driving region where the fuel injection quantity Ti is smaller, and therefore, a large correction by the air-fuel ratio feedback correction coefficient LMD or learning correction coefficient KBLCR becomes necessary. Since a substantially proportional relationship is established between the sucked air flow quantity Q and the fuel injection quantity Ti, this tendency resembles the tendency of the air-fuel ratio (see FIG. 8) at the time of occurrence of the air leakage, and it is apprehended that the inadequate quantity of the correction of the voltage Ts will be erroneously diagnosed as occurrence of the air leakage.

In order to prevent this erroneous diagnosis, in the present embodiment, the injection characteristics of the fuel injection valve 10 of each cylinder are learned so that a desired fuel supply control can be made for each cylinder. In other words, the setting control of the voltage correction quantity Ts or basic fuel injection quantity Tp is matched so that erroneous diagnosis of the deviation of the air-fuel ratio caused by deterioration of the fuel injection valve 10 or the like as occurrence of the air leakage is prevented.

Figure 7:
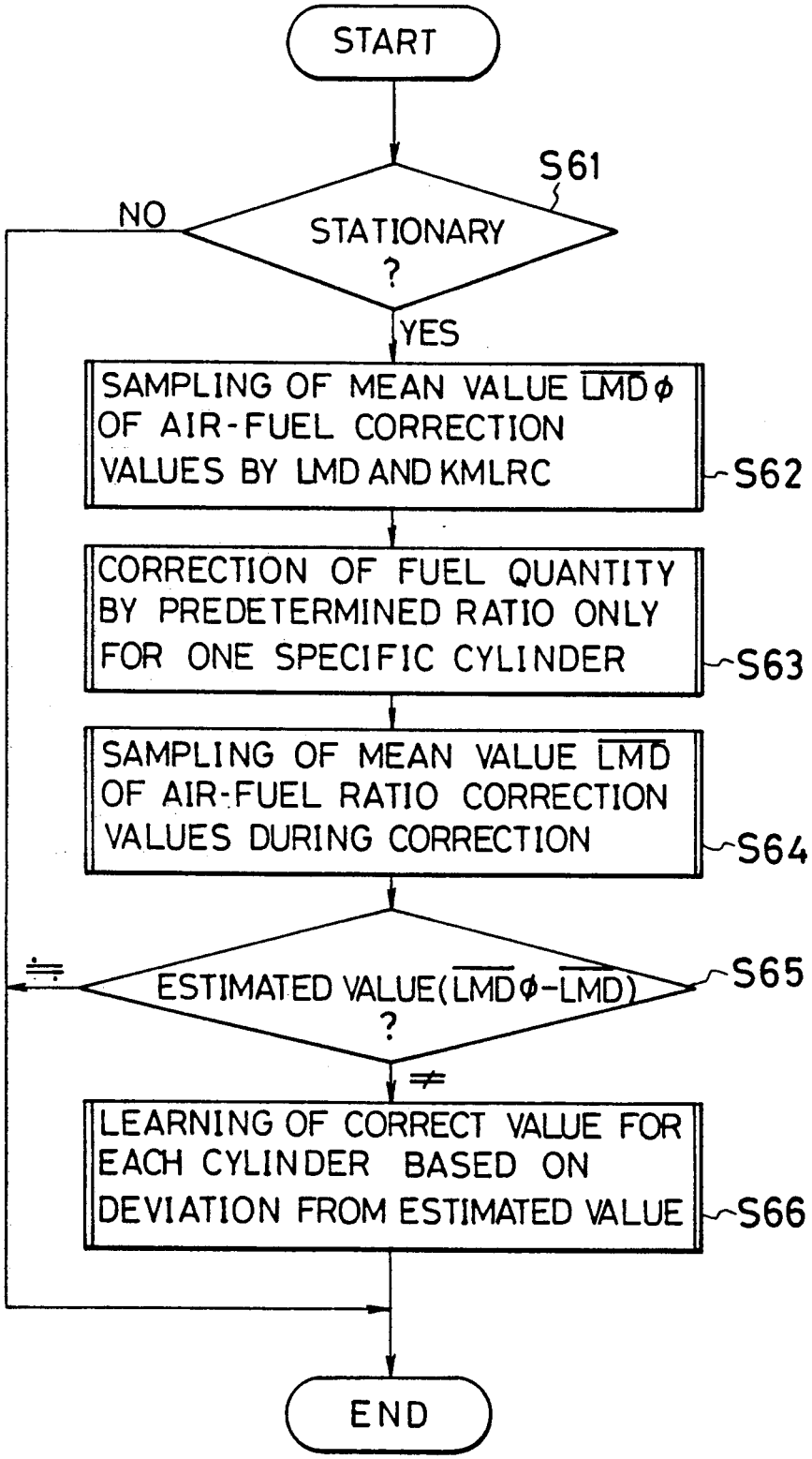

The outline of the learning correction of the fuel injection valve 10 of each cylinder is shown in the flow chart of FIG. 7.

The basic idea will be first described before the explanation is made with reference to the flow chart. For example, in case of a 4-cylinder engine, the oxygen concentration in the exhaust mixture from each of the four cylinders is detected by the oxygen sensor 14 and the average air-fuel ratio in each cylinder is detected from this oxygen concentration. Based on the result of this detection, the feedback control is carried out so that the average air-fuel ratio becomes equal to the target air-fuel ratio. If the fuel supply control quantity only for one specific cylinder is corrected and the air-fuel ratio is forcibly deviated only in this one specific cylinder, this deviation is detected by the oxygen sensor 14 and should be reflected on the value of the air-fuel ratio feedback correction coefficient LMD. This influence on the feedback correction system should be estimated based on the degree of the correction of the fuel quantity in said one specific cylinder.

Accordingly, if the estimated change of the air-fuel ratio correction value on the forcible deviation of the air-fuel ratio in one specific cylinder is compared with the change of the actually feedback-controlled correction value, an error of the injection characteristics of each cylinder, for example, a failure to inject a fuel in an increased quantity in one specific cylinder where the fuel quantity-increasing control is carried out, can be detected. If the correction value of the fuel injection quantity is learned so that the level of the fuel injection characteristics of each cylinder is corrected to the reference level, the target air-fuel ratio can be obtained in each cylinder.

Referring to the flow chart of FIG. 7, at step 61, it is judged whether or not the engine 1 is stationarily driven. When the engine 1 is transiently driven, the air-fuel ratio is unstable because of influences of the wall stream of the fuel and learning of a high precision is impossible. Accordingly, the present routine is ended.

When the engine 1 is stationarily driven, the routine goes into step 62. At step 62, in this stationary driving state, the air-fuel ratio feedback correction coefficient LMD set for the feedback control of the average air-fuel ratio of each cylinder to the target air-fuel ratio and the air-fuel ratio-learning correction coefficient KBLRC are sampled for a predetermined time, and the mean value of the air-fuel ratio correction value necessary for obtaining the target air-fuel ratio is determined.

Then, at subsequent step 63, for example, only the basic fuel injection quantity Tp of one specific cylinder is increase-controlled by a predetermined coefficient for a predetermined time to forcibly deviate the air-fuel ratio of said one specific cylinder.

While the basic fuel injection quantity Tp is thus corrected only in one specific cylinder, at step 64, the air-fuel ratio feedback correction coefficient LMD and the air-fuel ratio-learning correction coefficient KBLRC are sampled in the same manner as at step 62, whereby the average value of the air-fuel ratio correction value is determined.

As the result of the correction of the fuel quantity only in one specific cylinder, the degree of the change of the correction value for correcting the actual air-fuel ratio to the target air-fuel ratio is detected, and if the injection characteristics of the fuel injection fuel valve 10 of the cylinder where the fuel quantity is corrected are at the reference level and the fuel is actually injected and supplied in a quantity matched with the correction, the change of this correction value should be substantially in agreement with the estimated value (step 65).

Accordingly, if the value of the actual change of the air-fuel correction value is compared with the estimated value of this change, it can be judged whether or not the fuel injection valve 10 disposed in one specific cylinder where the fuel quantity is corrected actually projects and supplies the fuel in a quantity matched with the correction, and if an error of the fuel injection characteristics is detected, this error is stored according to the fuel injection quantity Ti, and by judging the degree of the change of the error according to the change of the fuel injection quantity Ti, the cause of the deterioration of each fuel injection valve 10 can be clarified at step 65, and the fuel correction value in the corresponding cylinder can be learned.

For example, if one of a plurality of injection holes of the fuel injection valve 10 is clogged, it becomes necessary to correct the fuel injection quantity at a certain ratio, and these characteristics are learned based on the fact that the proportion of the error of the injection characteristics is substantially constant to the change of the fuel injection quantity Ti. Furthermore, if the voltage correction quantity Ts is inadequate, since Ts is a correction factor to be added to the basic fuel injection quantity Tp, the learning is carried out based on the fact that the smaller is the fuel injection quantity Ti, the larger is the manifested correction proportion.

If the learning correction is thus carried out so that the fuel is actually injected and supplied in a quantity matched with the control quantity in each cylinder, even if the tendency of the deviation of the air-fuel ratio by the air leakage resembles the tendency of the deviation of the air-fuel ratio by an inadequate voltage correction quantity Ts, in the state where the influences of the fuel injection valve 10 are removed by the preliminary learning and correction of the voltage correction quantity Ts, the self-diagnosis of the air-fuel ratio in FIGS. 3 through 5 and the learning based on the result of this diagnosis are carried out, whereby the precision of the self-diagnosis of the air leakage can be improved and erroneous learning can be avoided.

I claim:

1. A method for the self-diagnosis of the leakage of air in a control system of an internal combustion engine, in which a flow quantity of air sucked in the internal combustion engine is detected and an engine control quantity including at least a quantity of a fuel to be supplied into the engine is set based on the detected air flow quantity, said method comprising setting an air-fuel ratio correction value for correcting the fuel supply quantity set based on the detected value of the sucked air flow quantity so that the air-fuel ratio in an air-fuel mixture sucked into the engine, which is detected through the detection of an exhaust component of the engine, is brought close to a target air-fuel ratio, wherein when there is observed a tendency that the proportion of the correction of the fuel supply quantity by the set air-fuel ratio correction value increases in a correction-increasing direction in a driving region having a smaller sucked air flow quantity, it is judged that the leakage of air into the suction system of the engine occurs.

2. A method for the self-diagnosis of the leakage of air in a control system of an internal combustion engine according to claim 1, wherein when occurrence of the leakage of air into the suction system of the engine is judged, the quantity of correction of the sucked air flow quantity, corresponding to the quantity of leaking air, is learned based on the above-mentioned air-fuel ratio correction value and the sucked air flow quantity corresponding to said air-fuel ratio correction value, and the detected value of the sucked air flow quantity corresponding to the quantity of leaking air is corrected based on this correction quantity of the sucked air flow quantity and the corrected value is used for setting the engine control quantity.

3. A method for the self-diagnosis of the leakage of air in a control system of an internal combustion engine according to claim 1, wherein the air-fuel ratio in one specific cylinder among a plurality of cylinders is forcibly changed by a predetermined value by correction of the fuel supply quantity for said specific cylinder, the difference of the air-fuel ratio correction value before and after said change of the air-fuel ratio is detected, and the correction value of the fuel supply quantity in said specific cylinder is set so that said difference of the air-fuel ratio correction value is brought close to a predetermined target value corresponding to the change of the air-fuel ratio, whereby the quantity of correction of the fuel supply quantity for correcting the fuel supply characteristic in each cylinder is learned, and the self-diagnosis of the leakage of air is accomplished while correcting the fuel supply quantity for each cylinder based on said correction quantity of the fuel supply quantity.

4. An apparatus for the self-diagnosis of the leakage of air in a control system of an internal combustion engine, in which sucked air flow quantity-detecting means is disposed to detect the flow quantity of air sucked in the engine and an engine control quantity including at least a quantity of a fuel to be supplied into the engine is set based on the detected air flow quantity, said apparatus comprising air-fuel ratio-detecting means for detecting an exhaust component of the engine and detecting the air-fuel ratio of an air-fuel mixture sucked in the engine based on the detected exhaust component, air-fuel ratio correction value-setting means for setting an air-fuel ratio correction value for correction of the fuel supply quantity based on the detected value of the quantity of sucked air so that the air-fuel ratio detected by said air-fuel ratio-detecting means is brought close to a target air-fuel ratio, and air leakage-judging means for judging occurrence of the leakage of air into the suction system of the engine when there is observed a tendency that the proportion of the correction by the air-fuel ratio correction value set by said air-fuel ratio correction value-setting means increases in a correction-increasing direction in a driving region having a smaller sucked air flow quantity.

5. An apparatus for the self-diagnosis of the leakage of air in a control system of an internal combustion engine according to claim 4, which further comprises leakage correction quantity-setting means for setting the quantity of correction of the sucked air flow quantity corresponding to the quantity of leaking air based on the air-fuel ratio correction value and the sucked air flow quantity corresponding to said air-fuel ratio correction value when occurrence of the leakage of air is judged, and sucked air flow quantity-learning correcting means for correcting the sucked air flow quantity detected by the sucked air flow quantity-detecting means based on the correction quantity set by said leakage correction quantity setting means and setting the engine control quantity based on the result of said correction.

6. An apparatus for the self-diagnosis of the leakage of air in a control system of an internal combustion engine according to claim 4, which further comprises means for learning the correction value for each cylinder, which is disposed to forcibly correct only the fuel supply quantity of specific one cylinder among a plurality of cylinders and change only the air-fuel ratio of said specific one cylinder, detect the difference of the air-fuel ratio correction value set by the air-fuel ratio correction value-setting means before and after said forcible correction, compare the detected difference with a predetermined expected value of said difference, and set the correction value of the fuel supply quantity of said specific one cylinder so that said difference is brought close to the predetermined expected value, whereby the correction value of the fuel supply quantity for each cylinder is learned.

* * * * *